US008456272B2

(12) United States Patent
Rauh et al.

(10) Patent No.: US 8,456,272 B2
(45) Date of Patent: Jun. 4, 2013

(54) ELECTRIC LINE

(75) Inventors: Hans-Georg Rauh, Olching (DE); Martin Krobok, Aichach (DE); Michael Weiβ, Benediktbeuern (DE)

(73) Assignee: W.E.T. Automotive, AG, Odelzhausen (DE)

( * ) Notice: Subject to any disclaimer, the term of this patent is extended or adjusted under 35 U.S.C. 154(b) by 31 days.

(21) Appl. No.: 13/181,600

(22) Filed: Jul. 13, 2011

(65) Prior Publication Data

US 2012/0013433 A1 Jan. 19, 2012

(30) Foreign Application Priority Data

Jul. 15, 2010 (DE) ..... 10 2010 027 408
Jun. 22, 2011 (DE) ..... 10 2011 105 675

(51) Int. Cl.
*H01C 13/00* (2006.01)

(52) U.S. Cl.
USPC ..... 338/296; 338/214; 219/549; 219/528

(58) Field of Classification Search
USPC ..... 338/296, 214; 219/549, 528; 174/128.1, 174/36
See application file for complete search history.

(56) References Cited

U.S. PATENT DOCUMENTS 4,245,149 A 1/1981 Fairlie
5,558,794 A 9/1996 Jansens
5,824,996 A 10/1998 Kochman et al.
5,861,610 A 1/1999 Weiss
5,904,874 A 5/1999 Winter
5,921,314 A 7/1999 Schuller et al.
6,005,232 A * 12/1999 Janvrin et al. ..... 219/549
6,057,530 A 5/2000 Gurevich
6,064,037 A 5/2000 Weiss et al.
6,084,217 A 7/2000 Bulgajewski
6,111,234 A 8/2000 Batliwalla et al.
6,147,332 A 11/2000 Holmberg et al.
6,150,642 A 11/2000 Weiss et al.
6,164,719 A 12/2000 Rauh
6,189,487 B1 2/2001 Owen et al.
6,229,123 B1 5/2001 Kochman et al.
6,294,758 B1 9/2001 Masao et al.
6,369,369 B2 4/2002 Kochman et al.
6,415,501 B1 7/2002 Schlesselman (Continued)

FOREIGN PATENT DOCUMENTS

DE 2157356 A1 5/1973
DE 3513909 10/1986

(Continued)

*Primary Examiner* — Kyung Lee
(74) *Attorney, Agent, or Firm* — The Dobrusin Law Firm, P.C.

(57) ABSTRACT

An electric line comprising: at least one conducting substrate including at least two heating fields of different width, at least one shared contacting device, wherein the conducting substrate includes a coating material disclosed on the conducting substrate that forms the at least two heating fields, and the same coating material is disposed on the at least two heating fields, and wherein an electrical conductivity of the coating material on one of the at least two heating fields is different than a second one of the at least two heating fields of different width so that upon application of the coating material on the at least two heating fields, each of the at least two heating fields have an identical electrical resistance, and wherein the at least one shared contacting device connects the at least two heating fields to an electrical potential by one or more connection lines.

20 Claims, 8 Drawing Sheets

U.S. PATENT DOCUMENTS

Figure 1:
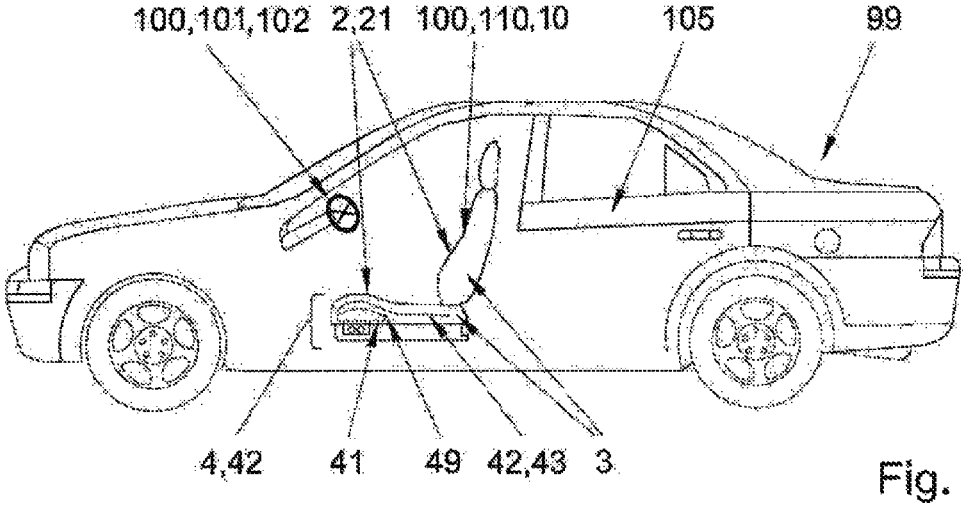

| | | | | |
|---|---|---|---|---|
| 6,426,485 | B1 | 7/2002 | Bulgajewski et al. | |
| 6,439,658 | B1 | 8/2002 | Ganz et al. | |
| 6,452,138 | B1 | 9/2002 | Kochman et al. | |
| 6,483,087 | B2 | 11/2002 | Gardner et al. | |
| 6,501,055 | B2 | 12/2002 | Rock et al. | |
| 6,664,512 | B2 | 12/2003 | Horey et al. | |
| 6,674,011 | B2 * | 1/2004 | Ueno et al. | 174/128.1 |
| 6,686,562 | B1 | 2/2004 | Weiss et al. | |
| 6,710,303 | B1 | 3/2004 | Lorenzen | |
| 6,713,733 | B2 | 3/2004 | Kochman et al. | |
| 6,838,647 | B2 | 1/2005 | Nagele | |
| 6,906,293 | B2 | 6/2005 | Schmiz et al. | |
| 7,040,710 | B2 | 5/2006 | White et al. | |
| 7,053,344 | B1 | 5/2006 | Surjan et al. | |
| 7,202,444 | B2 | 4/2007 | Bulgajewski | |
| 7,205,510 | B2 | 4/2007 | Howick | |
| 7,223,948 | B2 | 5/2007 | Howick et al. | |
| 7,306,283 | B2 | 12/2007 | Howick et al. | |
| 7,510,239 | B2 | 3/2009 | Stowe | |
| 7,560,670 | B2 | 7/2009 | Lorenzen et al. | |
| 2002/0117495 | A1 | 8/2002 | Kochman et al. | |
| 2005/0107572 | A1 | 5/2005 | Bastioli et al. | |
| 2005/0200179 | A1 | 9/2005 | Bevan et al. | |
| 2008/0290080 | A1 | 11/2008 | Weiss | |
| 2010/0044075 | A1 | 2/2010 | Weiss et al. | |
| 2011/0147357 | A1 | 6/2011 | Bokelmann et al. | |
| 2011/0290785 | A1 | 12/2011 | Schaeffer et al. | |
| 2012/0018414 | A1 | 1/2012 | Weiss | |

FOREIGN PATENT DOCUMENTS

| | | | |
|---|---|---|---|
| DE | 199 20 451 | | 12/1999 |
| DE | 10243584 | A1 | 4/2003 |
| EP | 0909638 | A2 | 9/1994 |
| EP | 1783785 | A | 5/2007 |
| JP | 03145089 | A | 6/1991 |
| JP | 2003/332030 | A | 11/2003 |
| JP | 2004/249092 | A | 1/2004 |
| WO | 94/09684 | A1 | 5/1994 |
| WO | 02/06914 | A1 | 1/2002 |
| WO | 2004/082989 | | 3/2004 |
| WO | 2004/114513 | A1 | 12/2004 |
| WO | 2005/047056 | | 5/2005 |
| WO | 2007/065424 | A | 6/2007 |
| WO | 2009/049577 | A1 | 4/2009 |

* cited by examiner

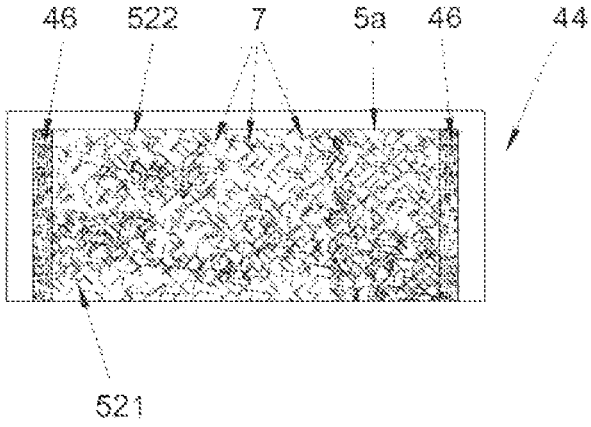
Fig. 2d
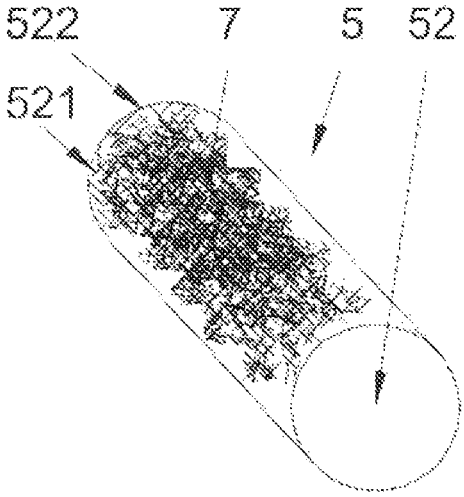
Fig. 3 a1

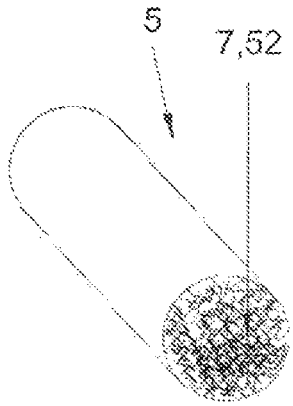
Fig. 3 a2
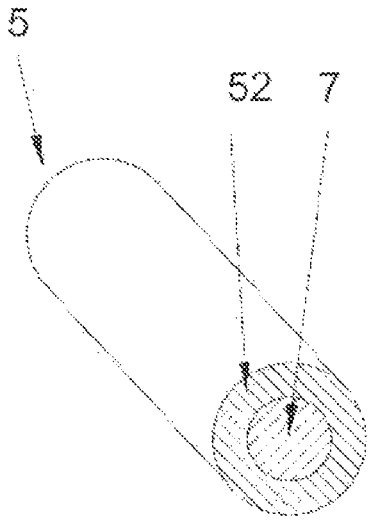
Fig. 3 a3

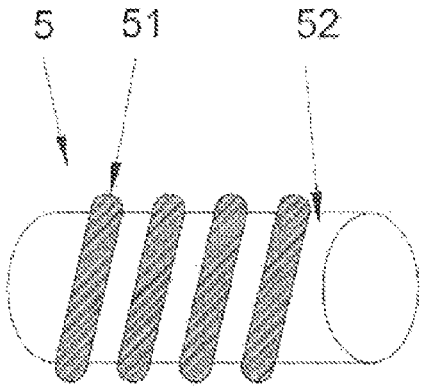
Fig. 3 b1
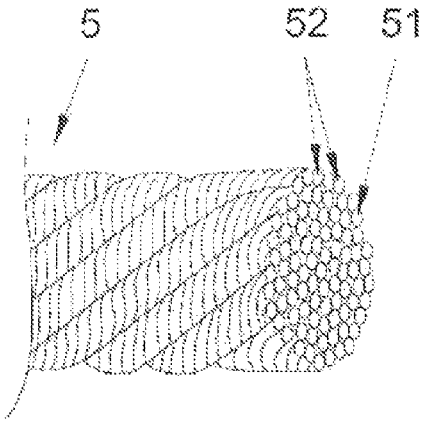
Fig. 3 b2

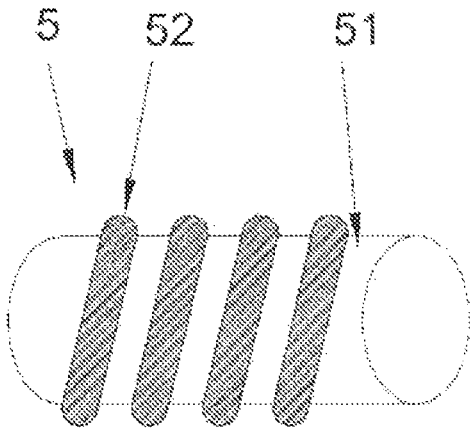
Fig. 3 b3
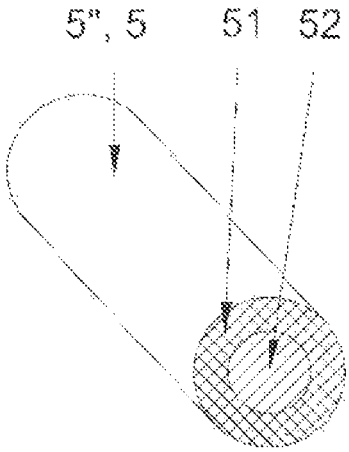
Fig. 3 c1

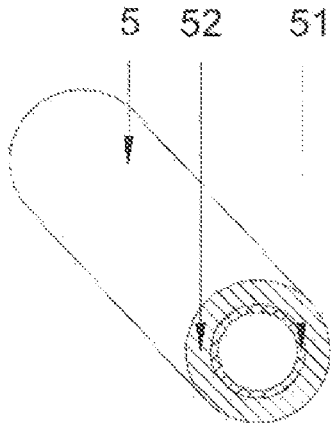
Fig. 3 c2
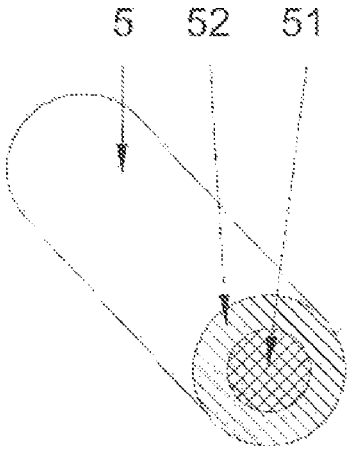
Fig. 3 c3

ELECTRIC LINE

CLAIM OF PRIORITY

The present application claims priority from German application nos. DE 10 2010 027 408.9, filed on Jul. 15, 2010 and DE 10 2011 105 675.4, filed on Jun. 22, 2011 to named applicant: W.E.T. Automotive Systems AG, inventors Hans-Georg Rauh, Dr. Martin Krobok and Michael Weiβ, disclosure of which is hereby incorporated by reference herein.

SUBJECT OF THE INVENTION

The invention concerns an electric line with at least one conducting substrate and at least one substrate support, on and/or in which the conducting substrate is arranged. Such lines are used, e.g., in electric resistance devices or in contacting devices, temperature control devices, air conditioning devices, detector devices, covers for temperature-controlled objects, vehicle interior components and/or it furnishing objects.

It is provided that the conducting substrate has at least one conducting particle.

Furthermore, it is provided that the conducting substrate has at least two strandlike conducting particles, which are in electrical connection with each other at least at one electrical contact point.

It is provided that the resistance device has at least two resistance zones which have an electrical conductivity different from each other.

FIGURES

Details of the invention will be explained below. These embodiments should make the invention comprehensible. However, they have the nature of examples. Of course, in the context of the invention, individual or several specified features can be left out, modified, or supplemented. The features of different embodiments can of course be combined with each other. What is decisive is that the concept of the invention is basically implemented. When a feature is at least partly fulfilled, this includes this feature also being completely fulfilled or basically completely fulfilled. "Basically" means in particular that the implementation enables an achievement of the desired benefit to a recognizable extent. This can mean, in particular, that a corresponding feature is at least 50%, 90%, 95% or 99% fulfilled. If a minimum quantity is indicated, then of course more than this minimum quantity can also be used. Unless otherwise indicated, intervals include their boundary points.

Figure 2A:
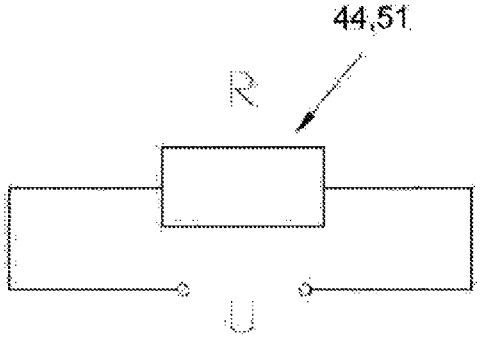

In what follows, reference is made to:

FIG. 1 side view of a motor vehicle 99 with temperature controlled objects 100 with temperature-controlled surfaces 10 such as a steering device 101, a steering wheel 102, a door paneling 105, a seat 110, in partial longitudinal section FIG. 2*a*) basic principle of the circuit of such a heating device 44 with a strandlike conducting substrate 51

Figure 2B:
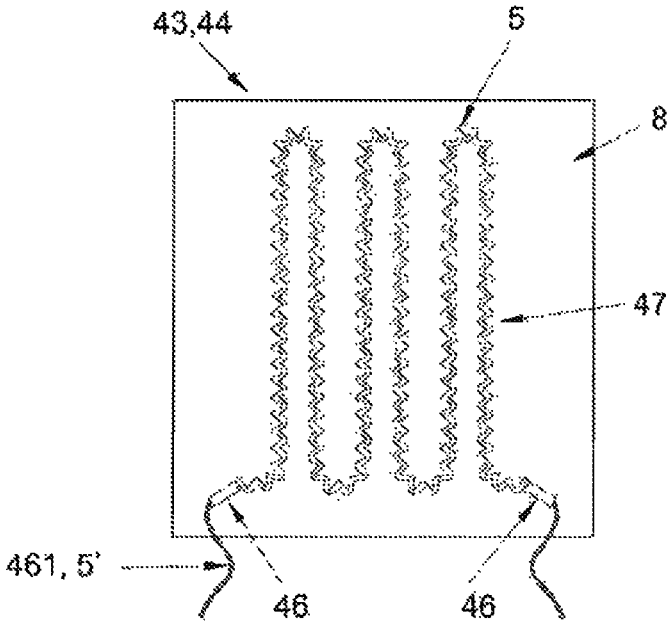

FIG. 2*b*) first example of a heating device 44 and a temperature control device 43 with a strandlike lines 5, 5', 461 as a heating conductor with two contacting devices 46 and a circuit brakes 47, which are arranged on a sheetlike supporting device 8.

Figure 2C:
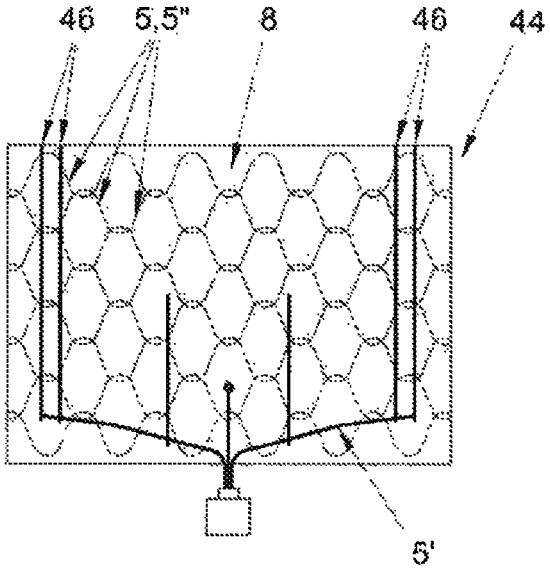

FIG. 2*c*) second example of a heating device 44, in which a plurality of strandlike lines 5, 5" are laid on a supporting device 8 between two contacting devices 46.

FIG. 2*d*) third example of a heating device 44, in which a plurality of conductive particles 7, adhesive compound 522, and fibers 521 form a conducting field 5*a*, which is arranged between two contacting devices 46.

Figure 2E:
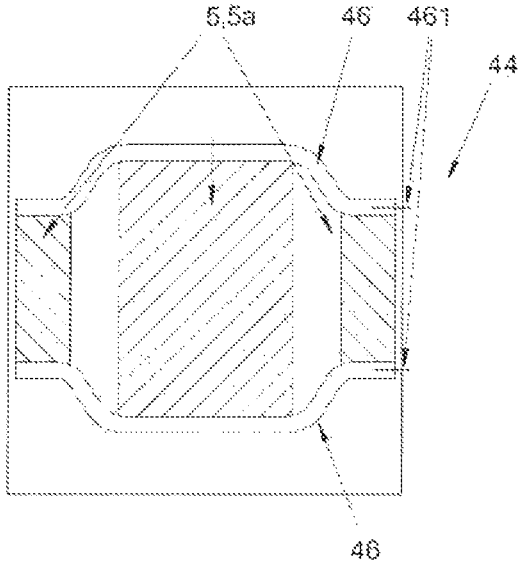

FIG. 2*e*) illustrates an example of a heating device 44 having different conducting fields 5*a* with standlike lines 5 arranged between two shared contacting devices 46 with connection lines 461

Figure 2F:
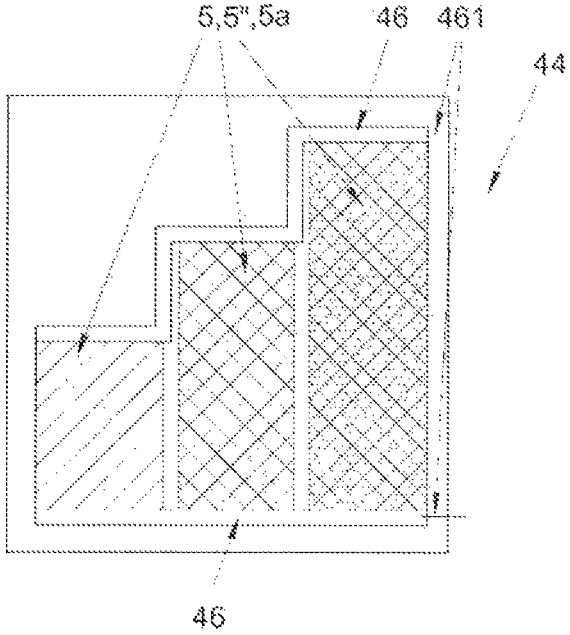

FIG. 2*f*) illustrates another example of a heating device 44 having different conducting fields 5*a* with standlike lines 5, 5" arranged between two shared contacting devices 46 with connection lines 461 in a different configuration.

FIG. 3*a*1) first example of an enlarged perspective view of an electric line 5, for example, from FIG. 2*b*), with a strandlike substrate support 52 with one or more fibers 521, an adhesive compound 522, and conductive particles 7 arranged on its surface.

FIG. 3*a*2) second example of a line 5 with a strandlike substrate support 52, in whose mass a plurality of electrically conductive particles 7 is embedded.

FIG. 3*a*3) third example of a strandlike line 5 with a tubular substrate support 52, whose hollow core is filled with a plurality of conducting particles 7.

FIG. 3*b*1) fourth example of a line 5 with a strandlike substrate support 52, about which a strandlike conducting substrate 51 is wound in spiral/helical form.

FIG. 3*b*2) fifth example of a line 5, in which strandlike conducting substrates 51 are stranded with strandlike support parts 52.

FIG. 3*b*3) sixth example of a line 5 with a strandlike conducting substrate 51 and a substrate support 52 wound about it in helical form.

FIG. 3*c*1) seventh embodiment of lines 5, 5" with a strandlike substrate support 52 and a coating deposited on it in tubular manner as a conducting substrate 51.

FIG. 3*c*2) eighth example of a line 5 with a tubular substrate support 52, in which a tubular conducting substrate 51 is inserted. A cavity can remain here in the core or a filling can be provided with a conductive or nonconductive material.

FIG. 3*c*3) ninth example of a line 5 with a tubular substrate support 52 and a strandlike conducting substrate 51 arranged therein.

DESCRIPTION OF THE INVENTION

The invention pertains to the temperature control of at least one temperature-controlled object 100. This includes, in particular, all objects or surfaces touched by people or endangered by frost, such as airfoils, transmitting stations, refrigerators, interior furnishing objects of houses, doors, windows, ceilings, recliners, cushions, etc. It can also involve, as here, an interior furnishing object of an air, water, land, railway or motor vehicle 99, such as that per FIG. 1, as for example a steering device 101, a steering wheel 102, a dashboard 103, an arm rest, a door paneling 105, a sitting surface, a vehicle ceiling, a cushion, an upholstery cover or, as here, a seat 110.

At least one object 100 being temperature-controlled has one or more temperature-controlled surfaces 10. Preferably, at least one temperature-controlled surface 10, like the sample embodiment of FIG. 1, preferably has at least one cover 2. Cover means any kind of layer, upholstery back cloth, or laminate, which at least partly covers the temperature-controlled object 100; especially such a one that is arranged as a continuous sheetlike component on the temperature-controlled object 100 and/or can basically be continuously detached from it. In addition or alternatively, a temperature-controlled surface 10 can also be provided with one or more coatings. By coatings is meant in particular such layers as are arranged at least temporarily as small particles (e.g., granulate or powder) or liquid (such as dipping lacquer, spray lacquer, or melted particles) on the temperature-controlled object 100 and, after solidification, form a continuous formation of predominantly two-dimensional extent. In addition or alternatively, a temperature-controlled surface 10 can have an at least partly continuous component 21 with basically sheetlike parts, such as textile, leather, nonwoven fabric and/or spacer materials, such as spacer fabrics. Several sheetlike components of the temperature-controlled surface 10 can be sewn, glued, riveted, Velcro fastened, welded together, or so on.

At least one temperature-controlled object 100 has preferably one or more cushions 3. These are preferably configured as foam rubber bodies and are part of a seat 110, a steering wheel 102, and so on.

One or more air conditioning devices 4 are coordinated with at least one temperature-controlled object 100 and at least one temperature-controlled surface 10 in order to control their temperature or air condition them.

At least one air conditioning device 4 advisedly has one or more air conducting devices 41. By air conducting device 41 is meant any device that can be used for the air exchange for the specific changing of the air composition or the air flows in a particular surface or volume region, such as an onboard climate control system, spacer media, spacer fabrics and/or air conditioning inserts at least partly permeable to air.

At least one air conditioning device 4 advisedly has one or more humidity regulating devices 42. By humidity regulating device is meant a device that serves to regulate the humidity of the air in its surroundings, especially the mentioned air conducting devices, temperature control devices 43 or humidity absorbers, such as activated charcoal fibers or polymer superabsorbers.

At least one air conditioning device 4 advisedly has one or more temperature control devices 43. By temperature control device 43 is meant any device that can be used for the specific changing of the temperature in its surroundings, e.g., all devices with at least one electrical heating resistor per FIGS. 2 and 3, a heat pump, a Peltier element and/or an air moving device, such as a fan.

At least one temperature control device 43 preferably has at least one electrical heating device 44. Such a heating device is preferably designed as a textile surface heating element. It can be used, e.g., as an insert in the cushioning of a furnishing object, such as a seat 110.

At least one heating device 44 preferably has one or more electrical resistance devices 45, to convert electrical energy into thermal. Preferably, one or more electrical resistance devices 45 are configured so that they lose at least partly their electrical conductivity at temperatures over 100° C., depending on the application also over 200° C. or over 250° C. Depending on the application, this can be below 150° C., below 200° C. or also below 260° C. At least one resistance device 45 and/or one of its components preferably has a PTC effect.

At least one resistance device 45 preferably has one or more lines 5 for the temperature control.

A heating device 44 preferably has one or more contacting devices 46, in order to apply an electrical potential at least on one resistance device 45.

Preferably the heating device 44 has two or more contacting devices 46, which are arranged on a resistance device 45 at least partly spaced from each other. Preferably, they are arranged near the edge along the resistance device 45 and fastened to it, e.g., by sewing, gluing, or imprinting. They can have an elongated contour and run essentially in a meandering fashion (e.g., FIGS. 2*e*), *f*)) and/or in a straight line (FIGS. 2*c*), *d*)). They are preferably arranged roughly parallel to each other and connected at one of their ends to a current/voltage source by a one or more connection lines 461 (e.g., FIGS. 2 *e*) *f*)). If more than two contacting devices 46 are arranged on a resistance device 45, certain of their regions can have current applied to them independently of the others.

Contacting devices 46 can basically be made from the same materials as a resistance device 45. For this, a rather large quantity of a conductive material is preferably provided. This can be done, e.g., by imprinting a resistance device on a sheetlike support device, e.g., with silk screening. After this, one or more additional layers are imprinted in the edge region, in order to form electrodes.

A contacting device 46 preferably has one or more lines 5' for making contact, being in electrically conductive connection with a resistance device 45. Advisable, in particular, is a number of two to ten, preferably three to eight contact conductors.

A heating device 44 advisedly has one or more temperature sensors. These monitor the temperature level of the heating element and/or the surroundings in order to assure maximum comfort and safety. Such a temperature sensor can be, e.g., a thermostat.

At least one heating device 44 advisedly has one or more circuit breakers 47, to interrupt the current supply to at least one resistance device 45 and/or one conductor device. In this way, needless energy consumption and unpleasant temperatures can be avoided. Such a circuit breaker 47 can be formed by at least one line 5", which loses its electrical conductivity at least partly and/or at least temporarily in event of passing a temperature threshold value, e.g., by melting or burn-through.

An air conditioning device 4 preferably has one or more detector devices 49, e.g., in the form of humidity sensors, in order to determine the moisture in a seat and/or the surrounding air or other parameters.

The air conditioning device 4 or one or more of its components (e.g., resistance device 44, contacting device 46, etc.) has one or more lines 5, 5', 5". These can be designed, e.g., as contacting devices 46 or connection lines 461 to the current line, as resistance devices 45 to produce heat, and/or detector devices 49 to monitor the temperature.

Preferably, the electrical conductivity of at least one line 5, 5', 5" at undesired high temperature (e.g., 200° C. to 400° C., better between 220° C. and 280° C.) is temporarily or permanently at least locally reduced or eliminated entirely. This prevents an unacceptably high heating. It can be provided that the line 5 is interrupted partly or basically entirely, reversibly or irreversibly, in the mentioned temperature range.

Preferably, the electrical resistance of at least one line 5, 5', 5" fluctuates preferably at least in one particular temperature range by at most 50% of its resistance at room temperature (around 20° C.), or better by at most 30% or 10% The temperature range preferably covers the interval of −10° C. to +60° C., or better −20° C. to +150° C., or better −30° C. to +200° C. This can be accomplished, e.g., by pre-stretching, warm-storing, water baths, or the like. This holds especially for plastic-containing lines 5. Preferably, the electrical resistance lies between 0 and 3 Ω/m, better 0 and 2 Ω/m, better 0.1 and 0.3 Ω/m for the current transport or between 0.1 and 5 Ω/m, better 0.8 and 3 Ω/m, for the heating.

Preferably at least one line 5, 5', 5" has at least one conducting substrate 51 for the conducting of electric current and/or at least one substrate support 52 to support the conducting substrate 51.

Preferably at least one substrate support 52 is partly or basically entirely made from a material having a greater resistance to alternating bending and/or a distinctly higher material price and/or a lower tensile or compressive strength than the material of the conducting substrate 51. In addition or alternatively, a substrate support 52 can also contain one or more fibers 521 of a high-strength material, such as Aramid, carbon, Zylon, etc. By high-strength is meant in particular a material with a tensile strength of more than 2500 N/mm$^2$ or 2500 MPa. Preferably, one or more mineral fibers are used, e.g., glass. This provides a high temperature resistance and is especially suitable for use in a load-bearing inner strand of a line.

In addition alternatively, preferably one or more substrate supports 52 have one or more fibers 521 that are formed partly or entirely from plastic, e.g., from carbon, nickel-clad carbon fibers, Nylon, polyethylene, PVC, polyimide, polyamide (e.g., 1.2, 3.4, 53, 6.6, 6.10, 7.2, 8.1), polypropylene, polyester, polyurethane etc. These materials are easy to process and economical in price. They are especially suitable for an inner strand 52*a*, but also, e.g., as an adhesive compound in a conducting substrate 51. A plastic is any synthetic material not occurring in nature, especially polymers and substances derived from them, like carbon fibers. Preferably, the chosen material is elastic and resistant to tearing.

For lines 5, 5', 5" without a PTC characteristic, at least one substrate support 51 is preferably designed so that it loses its material coherence upon passing a certain temperature value. For this, it may be advisable for the substrate support 52 to be made from a material that chemically decomposes or evaporates once certain temperature values are passed, so that it at least partially dissolves and is broken up. In this way, the supporting basis is taken way from the conducting substrate 51 once an unacceptable heating occurs. For this, it can be expedient that the substrate support 52 shrink, contract, and/or tear and thereupon disrupts/rips a layer above it that forms the conducting substrate 51, so that the conductivity of the conducting substrate 51 is ruined. It can be expedient for this that the substrate support 52 be made at least partly from a material with "memory" effect. It can be expedient for the substrate support 52 to at least partially melt, soften or decompose at temperatures between 100° C. and 400° C., preferably between 150° C. and 300° C., preferably between 220° C. and 280° C., here, at 270° C. At least one substrate support 52 preferably has a material that remains chemically and/or mechanically at least as stable up to at least 150° C., preferably up to at least 200° C., preferably up to at least 250° C. as under standard conditions. In this way, the material is sufficiently heat-resistant for the ordinary heating duty. Heat resistant means that the particular material insignificantly changes its shape and its strength under routine temperature changes, remains chemically stable, and keeps the same state of aggregation as under standard ambient conditions.

The electrical resistance of a line 5 with conductively coated materials depends not only on the quality of a conductive coating serving as a conducting substrate 51, but also on the quality of the substrate support 52. In particular, the long-term stability of the electrical resistance is strongly influenced by this, because a disruption of the substrate support 52 can also damage the conducting substrate 51 supported by it.

It has been found that the long-term resistance of a substrate support 52 to aging, material fatigue and thermal stress, especially in the case of polymer materials, is especially high when at least parts of the material of the substrate support 52 have a high molecular weight and/or a high crystallinity. This holds at least as long as these stresses remain below the melting point, the softening temperature, and/or the decomposition temperature of the material. A certain energy per gram is needed to melt crystals. The more or greater the crystals are per unit of mass of the plastic, the more energy will be needed. Therefore, the melting energy per mass (J/g) is a measure of the crystallinity of a partly crystalline plastic.

Extensive tests have shown that the stability is especially good when at least 50% of the material of the substrate support 52 is in crystalline form, while the other fractions are present in amorphous structure. Preferably, the crystallinity of a plastic is at least 50 J/g, preferably at least 60 J/g, even better 70 J/g. This increases the adhesion of a coating to the substrate support 52. This holds in particular for the aforementioned plastics. Furthermore, it was established that making the substrate support 52 from a material with high molecular weight counteracts the penetration of water into the support material. Preferably the molecular weight of one, several, or basically all of the substrate supports 52 is therefore at least 40,000 g/mol, better 100,000 g/mol, better 130,000 g/mol, better 200,000 g/mol or more. This holds in particular for the aforementioned plastics.

Preferably one or more substrate supports 52 have at least fractions of a material whose electrical conductivity behaves differently in regard to at least one parameter of influence than at least one material fraction of at least one conducting substrate 51. Preferably, the electrical conductivity changes in dependence on the temperature.

Substrate supports 52 are usually made at least for the most part of an electrically nonconducting material. But it can also be specified that at least one substrate support 52 is made entirely or partially from an electrically conducting material and carries part of the current. This can be advisable, e.g., for lines 5, 5', 5" with PTC characteristic. In such a case, preferably the greater part of the current flows across the conducting substrate 51 and less than 50%, better less than 20%, better less than 10%, across the substrate support 52. Advisable for this are, e.g., metals like copper, steel or nickel, electrically conductive plastics, graphite, or mixtures of alloys thereof.

It can be expedient for the substrate support 52 to have a thickness of less than 500 μm, preferably between 100 and 2 μm, preferably between 50 and 0.1 μm, preferably between 15 and 0.1 μm.

Preferably at least one substrate support has, at least for a section, an adhesive compound 522, or it is formed wholly or partly from it, in order to support one or more conducting substrates 51 or parts thereof. At least one part of the adhesive compound 522 is preferably at least partly formed from an at least temporarily adhesive and/or nonmetallic material and/or a material with the potential to connect joining parts surface bonding (abhesion) and/or internal strength (cohesion). At least one part of the adhesive compound 522 is preferably applied at least partly by brush application on a sheetlike support device 8 remaining permanently or temporarily in the temperature control device 43, sprayed on with pressure, deposited by dipping in a bath or by powder coating. This includes in particular melt, contact, powder and/or spray adhesives or corresponding bonding agents. Especially well suited are materials with at least fractions of rubber, PU, synthetic resin, adhesives and/or plastisols.

Preferably, at least one line 5, 5', 5" has one or more conducting substrates 51. By this is meant such components of the line 5 that have at least for a section and/or temporarily a specific electric conductivity of at least 1 million Ω*cm, preferably at least 1 Ω*cm.

Preferably one or more conducting substrates 51 are partly or basically entirely arranged on or in a substrate support 52. This can be done, e.g., by intimate material connection., e.g., in that one or more conducting substrates 51 are provided as sheetlike and/or tubular coating on or around a sheetlike or strandlike substrate support 52. It is also possible, e.g., for a conducting substrate 51 to be fastened, e.g., as a strand, band, netting or layer, by form fitting or nonpositive fitting, e.g., by weaving, knitting, sewing on or in a sheetlike substrate support 52 or by winding in a spiral around a strandlike substrate support 52. Preferably, one or more conducting substrates 51 are directly coordinated partly or basically entirely with a surface being temperature-controlled, e.g., by arrangement on a cover 2 and/or embedding at least partly in an object 100 being temperature-controlled, e.g., by foaming or casting in a cushion foam rubber.

Preferably one or more conducting substrates 51 are formed or a section or basically entirely as a layer 51.1 and have at least for a section material thickness, especially a layer thickness, of 1 nm to 15 μm, better 1 nm to 1 μm, better 20 nm to 0.1 μm. Since usually only one thin layer can be applied in one process step, several layers can also be provided one on top of another. Preferably one or more conducting substrates 51 are applied for a section or basically entirely by lacquering, dipping, painting or by cathodic immersion painting or extrusion. Between one or more conducting substrates 51 and one or more substrate supports 52, a chemically inert material is preferably deposited at least in a spot or section, such as a layer with 1-100% fractions of silver, palladium and/or gold. This can produce an improved bonding of subsequently applied materials on a substrate support 52 that forms the actual conducting substrate 51 or the larger portion of the conducting substrate 51.

Preferably one or more conducting substrates 51 has, for a section or basically entirely, the shape of a strand, band, netting and/or a helix or spiral. It can be provided that a conducting substrate 51 is irregularly shaped and has, e.g., zones of different material thickness. In particular, the conducting substrate 51 can have constrictions, thickenings, and/or recesses. In this way, one can also create from a homogeneous material regions in the conducting substrate 51 whose electrical resistance is specifically adjusted.

Preferably one or more conducting substrates 51 are formed for a fraction or basically entirely from a material that has a PTC characteristic. Suitable for this are, e.g., graphite-containing plastics, especially materials filled with carbon black. Preferably a material is used whose electrical resistance rises especially in nonlinear fashion at temperatures above 120° C., preferably above 70° C. For example, the material applied can be "7282 PTC Carbon Resistor" from DuPont, which shows at around 80° C. a nonlinear, very abrupt rise of the resistance to twice to 20 times the value at room temperature. With this, one can very easily achieve a self-regulating heating element that cannot get overheated in any operating duty.

Preferably one or more conducting substrates 51 are made partly or basically entirely from a material whose conductivity is long-term stable, even in an environment with high humidity, preferably one having an electrical conductivity of at least 80%, better 90%, better 95% of its original value according to a humidity testing per DIN EN 600068-2-30. Especially suitable for this are materials having at least fractions of one or more of the following materials: metal, copper, copper alloy, nickel (especially with phosphorus fractions), carbon particles, carbon fibers, carbonized plastic filaments, silver, gold, zinc, Baytron, Baytron P, polyaniline (PANI), polythiophen, poly(3,4-ethylene dioxythiopen) (PEDOT), polystyrene sulfonate (PSS), polyacetylene (PA), polyphenylene (PP), polyphenylene vinylene (PPV), polythiophene (PT) and/or combinations and/or compounds containing the mentioned materials, molecules and/or derivatives.

Preferably one or more conducting substrates 51 have one or more fibers 521. These can consist, e.g., at least partly, of an electrically conductive material such as carbon. However, they can also be formed at least partly from a poorly electrically conducting or nonconducting material. Such fibers 521 are preferably at least partly embedded in the rest of the material of the conducting substrate 51 and increase its mechanical strength. Such a conducting substrate 51 could thus have, e.g., a metal layer or graphite layer around a strandlike substrate support 52 and inclusions of additional carbon or metal fibers.

One or more lines preferably have a plurality of conducting particles 7. By particle is meant small units of material, e.g., particles, granulate, fibers, fiber fragments, powder, grains or mixtures thereof, that are preferably smaller in one, two or three dimensions than 2 cm, better 1 cm, better 5 mm, better 2 mm, better 1 mm. Preferred are diameters of around 50 μm to around 3 mm, better 0.01-4 mm, and/or lengths of around 50 μm to around 20 cm (better 0.01-5 cm). Such conducting particles 7 are economical, corrosion-resistant and temperature-insensitive. A conducting particle 7 can form a conducting substrate 51. It can also be provided that a plurality of conducting particles 7 a conducting substrate 51, possibly making use of an adhesive compound 522.

A certain fraction or basically all conducting particles 7 are formed from a preferably homogeneous, preferably electrically conductive material, preferably at least a fraction being carbon, steel, intrinsically conductive plastic, carbon black-filled Lycocell or other metals. Fiberlike particles are especially suitable, since when embedded in an adhesive compound 522 they enable a better current conductivity. Especially suitable are carbon nanotubes, graphite nanofibers or carbon filaments. This ensures a good electrical conductivity, mechanical robustness, and corrosion resistance. Carbon nanotubes (CNT) are tubular formations of carbon with a diameter of around 1-50 nm and a length of up to several millimeters. The electrical conductivity of the tubes is metallic, semiconductor, or at low temperatures superconducting. CNTs have a density of 1.3-1.4 g/cm$^3$ and a tensile strength of 45 billion Pascal. The current-carrying capacity is around 1000 times that of copper wires. The thermal conductivity at room temperature is 6000 W/m*K. Graphite nanofibers are (massive) fibers of carbon with a diameter less than 1 μm.

A certain fraction or basically all of the conducting particles 7 are at least partly embedded in an adhesive compound 522 (e.g., a lacquer, glue, or paste) and/or bonded to its surface. It can also be provided that they are entirely enclosed by the adhesive compound 522 (polyurethane based). Preferably the conductive particles form only at most 10% of the volume share of the resulting material, preferably at most 5%, or better 1%.

A certain fraction or basically all of the conducting particles 7 are preferably partly or basically entirely spaced apart from a surface being temperature controlled 10. In particular, regions of conducting particles 7 that are not embedded or not bonded preferably protrude from an adhesive compound 522 on the side turned away from the user and/or they are arranged on this side. Such a material, which contains conducting particle 7 and adhesive compound 522, can be, e.g., a dispersion, such as a paint material. Preferably, this material contains surfactants. It is preferably corrosion-resistant, tear-resistant, and economical in price.

Preferably every one or more lines 5, 5', 5", conducting substrates 51, conducting strands 55, heating devices 44 and/or temperature-controlled objects 100 have at least one jacket 53. The jacket 53 is at least partly arranged on the surface of a jacketed component and has one or more properties which the surface of the jacketed component does not have. By a jacket 53, the jacketed component is preferably at least partly separated from its surroundings. A jacket 53 is also, e.g., a formation that directly or indirectly at least partly covers or encloses the jacketed component, but not necessarily the outermost part of the jacketed component. A jacket 53 can be, e.g., configured sheetlike as a layer, tubular as a sheath, or in the form of a netting. Such a jacket 53 can be at least partly electrically conductive and form, e.g., a conducting substrate 51, an EMC screen, an antistatic coating and/or a signal transmission device. It can also be at least partly poorly electrically conductive or nonconductive and form, e.g., an insulation, a corrosion protection against aggressive media, a transfer protection and hot-spot protection, an adhesive connection device and/or a reinforcement of the mechanical strength of a line 5.

A jacket 53 can be made partly or basically entirely from plastic, adhesive, insulating material or a conductive material like metal, e.g., copper of sliver. It can, for example, be extruded, galvanized, dipped and/or polymerized. For this, preferably at least a part of the surface of the line and/or the conducting substrate is coated, especially with a plastic and/or an adhesive, a lacquer and/or at least for a section with polyurethane, PVC, PTFE, PFA and/or polyester. Such lines are especially corrosion-resistant and can furthermore be glued together by means of the coating.

It may be advisable that at least one jacket 53 and/or at least one conducting substrate 51 have, at least at parts of their surface, a surface that is chemically inactive under usual environmental conditions, at least on its surface facing outward (in terms of a substrate support 52 or a jacketed component). Chemically inactive means inert, i.e., the so designated object is not altered, even under the action of corrosive substances, at least not in the case of such substances as sweat, carbonic acid or fruit acids. The material can also be chosen so that it either does not corrode or forms electrically conductive corrosion products. For this, a metal can be provided whose surface can be passivated and/or is oxidized and/or is chromated. Especially suitable for this are noble metals like gold or silver. It is provided here that at least one conductor is formed, at least at parts of its surface, to contain metal, preferably at least fractions of nickel, silver, copper, gold, and/or an alloy containing these elements, preferably essentially entirely made from one of the mentioned materials. This reduces the junction resistance at a contact surface between a heating and a contact conductor. It is advisable for the jacket 53 to be metal-containing, preferably at least a fraction being made from an alloy, from nickel with phosphorus fractions, from silver, copper and/or from gold, preferably from an alloy that is basically entirely formed from silver, copper, gold and/or nickel. But it can also be made partly or basically entirely from each of the materials described for conducting substrates 51 and/or for substrate supports 52.

Preferably at least one line 5 has one or more conducting fields 5*a*. By the latter is meant an essentially sheetlike, at least partly electrically conductive structure. For example, it can have a foil, a textile or the like as conductive or nonconductive substrate support 52. A conducting field 5*a*, in any case, has one or more conducting substrates 51. Such conducting substrates 51 can either themselves form the essential component of the conducting field 5*a* (e.g., as nonwoven fabric made from electrically conductive fibers) or be arranged on or in a sheetlike substrate support 52 (e.g., as conducting strands sewn on or knitted into a textile support).

Preferably a plurality of conducting strands 55 and/or conducting fields 5*a* is provided, preferably in one or more contacting devices 46 and/or one or more resistance devices 45. Preferably one or more conducting strands 55/conducting fields 5*a* of a contacting device 46 are spatially and/or electrically connected to one or more conducting strands 55/conducting fields 5*a* of a resistance device 45.

At least one line 5 and/or one conducting field 5*a* has preferably one or more conducting strands 55 or is at least partly configured as such. The conducting strand 55 can be, e.g., a heating strand, a contact strand, an electrical fuse and/or a connection conductor. A conducting strand 55 is an at least partly electrically conductive strand, in which one or more filamentary, at least partly electrically conductive components extend, preferably basically along the lengthwise direction of the strand and/or arranged helically about it or in it. A conducting strand 55 can itself be made up from a plurality of conducting strands 55 or other, e.g., nonconductive partial strands.

By strand is meant here an elongated structure, whose lengthwise dimensions are far greater than the dimensions of its cross section. Preferably the two dimensions of the cross section have roughly the same dimensions. Preferably the structure is bending elastic. By filamentary is meant that the object so designated is formed from a short or long fiber or from a monofilament or multifilament thread. Preferably at least one strand has in at least one dimension a cross section dimension less than 1 mm, better 0.1 mm, better 10 μm.

Preferably one or more lines 5 and/or several conducting strands 55 have a plurality of partial strands 57, preferably more than five, preferably more than 50, preferably more than 100, preferably more than 300. One, several or basically all partial strands 57 have a thickness of less than 1 mm, preferably less than 0.1 mm, preferably less than 10 μm. A partial strand 57 is a strand that together with other strands forms a higher-level strand. It can be advisable for a conducting strand 55 and/or a line 5 to have two or more different types of partial strands 57. It can be provided that these have different materials and/or different dimensions from each other.

Preferably one, several or basically all partial strands 57 of a conducting strand 55 and/or a line 5 are formed at least in a fraction from copper or a copper alloy, preferably essentially from this. It can also be provided that one, several or basically all partial strands 57 of a conducting strand 55, a substrate support 52 and/or a line 5 are made of plastic and have a jacketing with copper and/or a copper alloy. Preferably, fewer than 50% of the partial strands 57 are of copper, copper alloy, and/or another metal-containing material, preferably 1% to 40%, preferably 10% to 35%. Preferably a number of more than 50% of the partial strands 57 are provided with a plastic core, preferably between 60% to and 99%, preferably between 60% and 80%. These values have been found by several test series to be especially favorable in terms of costs and durability.

Preferably one or more supporting strands 58 are provided, which take up a large portion of the mechanical load on the conducting strand 55 and/or the line 5. They are preferably made of a material that is stronger/tougher/less elastic than the material of the other strands, e.g., as here, basically from polyester or steel. Depending on the application, they are also preferably thicker and more numerous than the other strands. In this way, even thin strands can be effectively protected against bending and tensile stresses. The supporting strands 58 can be made for a fraction or basically entirely from an electrically conductive material and also from a poorly electrically conductive or nonconductive material.

Preferably one, several or basically all partial strands 57 are for a section or basically entirely electrically insulated from one, several or basically all other partial strands 57 of a strand. This can be done, e.g., by spacing them apart, e.g., by providing an air gap or by coating of one or more partial strands 57 or filling the strand interstices with an insulating material. By insulating material is meant any material whose specific electrical conductivity is at most one tenth of the specific electrical conductivity of at least one conducting substrate 51 of a conducting strand 55.

Preferably at least one line 5, at least one substrate support 52, at least one conducting strand 55, at least one partial strand 57 have at least for a section a round cross sectional shape. This enables a cost-effective manufacture. Alternatively or additionally, a nonround, especially a polygonal or star-shaped cross section will be considered for these or other structural parts. This allows for an enlargement of the surface. In this way, the electrical resistance of a coating is reduced as compared to a coating of the same thickness on a round cross section. A three-lobed cross section can further increase the abrasion resistance.

One or more conducting substrates 51 and/or one or more conducting strands 55 preferably have a spiral spatial arrangement, preferably by being twisted or stranded together and/or by helical arrangement about a strand, e.g., a substrate support 52. This enables heating conductors with particular tensile strength.

A line 5 preferably has one or more supporting devices 8, in order to carry additional components (e.g., the line 5). One or more such components are fastened to such a supporting device 8 by sewing with or without auxiliary threads, gluing, lamination, knitting on, knitting in, weaving in, metallization, etc.

One or more supporting devices 8 are preferably essentially strandlike, netlike and/or sheetlike and formed at least partly from a textile, knitted fabrics weave, nonwoven fabric, flexible thermoplastics, air-permeable material and/or a foil (e.g., punched or nappy). One or more supporting devices 8 can also be formed partly or basically entirely at least by a portion of the temperature controlled object 100, e.g., an interior furnishing object or at least a part of the temperature-controlled surface 10, e.g., the cover 2. Since the same requirements in terms of mechanical, chemical and electrical properties often hold for a supporting device 8 as for the substrate support 52, it can be provided that it be formed partly or basically entirely from at least one material recommended here for substrate supports 52. It can also be provided that a substrate support 52 itself forms a supporting device 8.

Preferably at least one heating resistance is formed by impregnating a textile (e.g., a nonwoven fabric) in an immersion bath, by imprinting a cover, from leather or foil, or by lacquering a hard object. The coating material here is preferably a dispersion of a bonding, hardening support substrate and electrically conductive particles.

A heating device 44 can have at least two heating fields of different width (e.g., FIG. 2*e*)). A heating device 44 can also have at least two heating fields of different length (e.g., FIG. 2*e*), FIG. 2*f*)). Preferably the at least two heating fields are connected by at least one shared contacting device 46 (e.g., an electrode) with at least one connection line 461 to an electrical potential (e.g., a pole of a battery) (e.g., FIG. 2*e*), FIG. 2*f*)). Preferably at least two heating resistances (measuring at their electrodes) have an essentially identical electrical resistance, but as different electrical conductivity from each other (considering identically long segments along the direction of current flow through the heating resistance). Ways of achieving this effect could be, for example:

a. At least two coatings of different thickness of a supporting device 8 with the same conductive coating material. This can be done, e.g., when imprinting a supporting device 8 with conductive paste by a different dense arrangement of ink spots on the supporting device 8. Especially suitable here is tampon printing, in order to imprint 3-dimensionally shaped supporting devices 8 (e.g., steering wheels 102, door panels, dashboards 103 or housings).

b. At least two resistance zones, in which a different number of layers of a coating material is placed on a supporting device 8 (e.g., by several printing processes in succession).

c. Coating materials with differing kind of specific conductivity on two different zones of a supporting device 8 (e.g., by different concentrations of particles or by particles in the support substrate differing in size, shape or material, or by support substrates of different conductivity).

d. A different degree of cross-linking of the conductive particles 7 in different resistance zones. By cross-linking is meant here all electrical contact points and especially all mechanically firm connections, especially intimate material connections, especially chemical connections, especially joining together of molecules, especially those of identical components, such as carbon lattices. Such cross-linking can be achieved, e.g., by flow of current through a heating resistance, which is preferably at least twice as high as the normal operating current. If different regions of a heating resistance or different heating resistances are subjected to different current magnitudes, different numbers of connection points will be formed between the particles 7 (this effect is based, e.g., on the migration of ions in the material).

e. Different orientation of the conducting particles 7. This can occur, e.g., by stretching of a heating resistance or certain zones thereof (e.g., by extruding of strand material or drawing of films).

LIST OF REFERENCE NUMBERS

2 cover
3 cushion
4 air conditioning device
5, 5', 5" electric line
5*a* conducting field
7 conducting particle
8 support device
10 temperature-controlled surface
21 structural part
41 air conducting devices
42 humidity regulating device
43 temperature control device
44 heating device
45 resistance device
46 contacting device
47 circuit breaker
49 detector device
51 conducting substrate
52 substrate support
52*a* inner strand
53 jacket
55 conducting strand
57 partial strand
58 support strand
99 motor vehicle
100 temperature-controlled object
101 steering device
102 steering wheel
103 dashboard
105 door paneling
110 seat
461 connection line
521 fibers
522 adhesive compound

What is claimed is:

1. An electric line comprising:

at least one conducting substrate including at least two heating fields of a different width, at least one shared contacting device including:

a coating material disposed on the conducting substrate that forms the at least two heating fields, and wherein the same coating material is disposed on the at least two heating fields, and wherein the coating material is applied to the at least two heating fields in a sufficient amount so that each of the at least two heating fields have an identical electrical resistance, and wherein the at least one shared contacting device connects the at least two heating fields to an electrical potential by one or more connection lines.

2. An electric line device according to claim 1, wherein each of the at least two heating fields have a different amount of layers of the coating material.

3. An electric line according to claim 1, wherein each of the at least two heating fields have a different thickness of the coating material.

4. An electric line according to claim 1, wherein the at least two heating fields are rectangular in shape.

5. An electric line according to claim 2, wherein each of the at least two heating fields have a different length, forming a heating field with a longest length and a heating field with a shortest length, and wherein the heating field with the shortest length has the least amount of layers of the coating material and the heating field with the longest length has the largest amount of layers of the coating material.

6. An electric line according to claim 3, wherein each of the at least two heating fields have a different length, forming a heating field with a longest length and a heating field with a shortest length, and wherein the heating field with the shortest length has a smallest thickness of the coating material and a heating field with the longest length has a biggest thickness of the coating material.

7. An electric line according to claim 1, wherein the at least one shared contacting device is an electrode.

8. An electric line according to claim 1, wherein the electrical potential is a pole of a battery.

9. An electric line according to claim 1, wherein the at least one shared contacting device forms a curve.

10. An electric line comprising:

at least one conducting substrate including at least two heating fields of a different width, at least one shared contacting device, and a coating material disposed on the at least one conducting substrate in each of the at least two heating fields of different widths;

wherein the at least one shared contacting device connects the at least two heating fields to an electrical potential by one or more connection lines; and wherein at least one of the at least one conducting substrate includes one or more conductive particles, and an adjacent one of the at least one conducting substrate is made of one or more conductive particles so that a conductivity of the at least one of the at least one conducting substrate and the adjacent one of the at least one conducting substrate are different so that upon application of the electrical potential in the at least two heating fields, each of the at least two heating fields have an identical electrical resistance.

11. An electric line according to claim 10, wherein the conducting substrate differs by concentrations of the conductive particles.

12. An electric line according to claim 10, wherein the conducting substrate differs by size of the conductive particles.

13. An electric line according to claim 10, wherein the conducting substrate differs by shape of the conductive particles.

14. An electric line according to claim 10, wherein the conducting substrate differs by conductivity of the conductive particles.

15. An electric line according to claim 10, wherein the conducting substrate differs by orientation of the conductive particles.

16. An electric line according to claim 15, wherein at least one resistance zone of the at least two heating fields has a different orientation of the conductive particles.

17. An electric line comprising:

at least one substrate including at least two heating fields of a different width, and a coating material disposed on the at least one substrate in each of the at least two heating fields of different widths;

wherein a plurality of conductive particles forms the coating material disposed on the at least one substrate, wherein a degree of cross-linking of the plurality of conductive particles differs in each of the at least two heating fields so that a conductivity of each of the at least two heating fields is essentially identical.

18. An electric line according to claim 17, wherein the electric line further comprises at least one shared contacting device.

19. An electric line according to claim 17, wherein the one or more heating fields have a different length.

20. An electric line according to claim 15, wherein each of the at least two heating fields have a different number of connection points between the plurality of conductive particles.

* * * * *

UNITED STATES PATENT AND TRADEMARK OFFICE

CERTIFICATE OF CORRECTION

PATENT NO. : 8,456,272 B2
APPLICATION NO. : 13/181600
DATED : June 4, 2013
INVENTOR(S) : Rauh et al.

It is certified that error appears in the above-identified patent and that said Letters Patent is hereby corrected as shown below:

Title Page 2, insert under item (56), col. 2, line 22,

-- NON-PATENT LITERATURE DOCUMENTS
1. Co-pending patent application serial no. 12/096,266, filed on 06/05/2008, published as 2008/0290080 (1063.015).
2. Co-pending patent application serial no. 13/204,152, filed on 08/05/2011, published as 2012/0018414 (1063.015C1).
3. Co-pending patent application serial no. 12/447,998, filed on 04/30/2009, published as 2010/0044075 (1063.021).
4. Co-pending patent application serial no. 12/738,345, filed an 03/31/2011, published as 2011/0290785 (1063.033).
5. Co-pending patent application serial no. 12/963,030, filed on 12/08/2010, published as 2011/0147357 (1063.038). --

Signed and Sealed this
Fifth Day of November, 2013

Teresa Stanek Rea
*Deputy Director of the United States Patent and Trademark Office*